US009757287B2

(12) United States Patent
Tsukada et al.

(10) Patent No.: US 9,757,287 B2
(45) Date of Patent: Sep. 12, 2017

(54) INTEGRATED-BED MATTRESS AND INTEGRATED BED

(71) Applicant: Panasonic Intellectual Property Management Co., Ltd., Osaka (JP)

(72) Inventors: Shohei Tsukada, Hyogo (JP); Yohei Kume, Osaka (JP); Hideo Kawakami, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 248 days.

(21) Appl. No.: 14/679,597

(22) Filed: Apr. 6, 2015

(65) Prior Publication Data

US 2015/0290054 A1 Oct. 15, 2015

(30) Foreign Application Priority Data

Apr. 15, 2014 (JP) ..... 2014-083280
Feb. 3, 2015 (JP) ..... 2015-019531

(51) Int. Cl.

| | |
|---|---|
| ***A61G 5/00*** | (2006.01) |
| ***A61G 7/16*** | (2006.01) |
| ***A61G 5/10*** | (2006.01) |
| ***A61G 5/12*** | (2006.01) |
| ***A61G 7/05*** | (2006.01) |
| *A61G 7/053* | (2006.01) |

(52) U.S. Cl.

CPC ..... *A61G 5/006* (2013.01); *A61G 5/1043* (2013.01); *A61G 5/125* (2016.11); *A61G 7/0514* (2016.11); *A61G 7/16* (2013.01); *A61G 7/165* (2016.11); *A61G 7/053* (2013.01)

(58) Field of Classification Search

CPC ..... A47C 31/02; A47C 31/023; A47C 31/00; A47C 21/026; A61G 5/006; A61G 2007/165; A61G 7/16; A61G 5/1043; A61G 7/015; A61G 13/08

USPC ..... 5/411

See application file for complete search history.

(56) References Cited

U.S. PATENT DOCUMENTS 1,782,239 A * 11/1930 Ledwinka ..... A47C 31/02 24/581.11
2,588,854 A 3/1952 Lang
2,673,356 A * 3/1954 Fleming ..... A47C 21/022 24/72.5

(Continued)

FOREIGN PATENT DOCUMENTS

| | | |
|---|---|---|
| EP | 1 541 109 | 6/2005 |
| EP | 2 583 650 | 4/2013 |
| JP | 2001-104102 | 4/2001 |

OTHER PUBLICATIONS

Extended European Search Report issued Sep. 22, 2015 in corresponding European Patent Application No. 15162987.0.

*Primary Examiner* — Eric Kurilla
(74) *Attorney, Agent, or Firm* — Wenderoth, Lind & Ponack, L.L.P.

(57) ABSTRACT

A mattress can be adapted to an integrated bed that includes a main bed unit, and a wheelchair unit that is separable from the main bed unit and has a wheelchair back bottom, a wheelchair hip bottom and a wheelchair foot bottom. The mattress includes a first protrusion configured to be fastened to a back-section hole in the wheelchair back bottom, a fastener configured to be fastened to the wheelchair hip bottom, and a second protrusion configured to be fastened to a foot-section hole in the wheelchair foot bottom.

17 Claims, 10 Drawing Sheets

(56) References Cited

U.S. PATENT DOCUMENTS 2,995,762 A 1/1960 Albinson
3,138,805 A * 6/1964 Piazza ..... A61G 5/00 297/411.34
3,284,126 A * 11/1966 Piazza ..... A47C 17/163 280/657
3,769,643 A * 11/1973 Adler ..... A47C 21/06 5/401
4,987,620 A * 1/1991 Sharon ..... A61G 5/006 5/600
5,062,171 A * 11/1991 Vrzalik ..... A61G 7/001 5/411
5,437,496 A 8/1995 Rickard
5,499,410 A * 3/1996 Assink ..... A47C 21/026 5/284
5,745,941 A * 5/1998 Miller, Sr. ..... A61G 7/05776 5/691
6,014,783 A * 1/2000 Collier ..... A47C 4/54 297/440.2
6,272,702 B1 * 8/2001 Uchida ..... A61G 5/006 5/600
6,889,396 B2 * 5/2005 Weinman ..... A47C 21/026 5/411
7,287,289 B1 * 10/2007 Hagopian ..... A61G 7/05769 5/600
7,810,194 B2 * 10/2010 Clenet ..... A47C 21/003 5/659
2006/0117479 A1 * 6/2006 Kawakami ..... A61G 7/008 5/411
2006/0191073 A1 * 8/2006 Honda ..... A61G 5/006 5/600
2011/0196562 A1 * 8/2011 Kume ..... A61G 5/006 701/23
2012/0153687 A1 * 6/2012 Kume ..... A61G 5/1067 297/118
2012/0159705 A1 * 6/2012 Tsukada ..... A61G 5/006 5/2.1
2012/0198623 A1 * 8/2012 Clenet ..... A47C 21/026 5/600
2012/0292883 A1 * 11/2012 Noonan ..... A61G 5/006 280/304.1
2013/0326814 A1 * 12/2013 Shan ..... A47C 20/00 5/613
2014/0123392 A1 * 5/2014 Shan ..... A47C 21/026 5/618
2014/0137328 A1 * 5/2014 Ohta ..... A61G 7/018 5/611
2014/0191541 A1 * 7/2014 Ohta ..... A61G 5/04 297/118
2014/0304914 A1 * 10/2014 Schnake ..... A61G 7/05 5/600
2015/0082537 A1 * 3/2015 Ohta ..... A61G 5/04 5/2.1
2015/0313779 A1 * 11/2015 Kume ..... A47C 20/08 5/616

* cited by examiner

INTEGRATED-BED MATTRESS AND INTEGRATED BED

BACKGROUND

1. Technical Field

The present invention relates to an integrated bed including a part that can be separated for use as a wheelchair, and a mattress used for the integrated bed.

2. Background Art

It is very hard a task for any care worker to move a bedridden elderly or a sick patient (hereinafter referred to as a care-receiver) from a bed to a wheelchair or from the wheelchair to the bed. Care workers often suffer pain in their lower backs when moving care-receivers. Thus, an integrated bed is proposed. A part thereof is separable and the separated part can be used as a wheelchair (refer to Japanese Unexamined Patent Publication, No. 2001-104102, for example).

FIG. 10 is a perspective view of conventional integrated bed 1. In integrated bed 1, a center part is convertible into wheelchair 2. According to this structure, the center part can be converted into a shape of wheelchair 2 by using actuator 3 provided on integrated bed 1 while the care-receiver stays lying in the center part. After that, the care-receiver can be moved on wheelchair 2 when the care worker simply pulls out the converted wheelchair 2.

SUMMARY

A first mattress for integrated bed of the present invention is applicable to an integrated bed having a main bed unit, and a wheelchair unit that is separable from the main bed unit and includes a wheelchair back bottom provided with a back-section hole, a wheelchair hip bottom, and a wheelchair foot bottom provided with a foot-section hole. This mattress for integrated bed has a mattress body, a first protrusion, a fastener, and a second protrusion. The first protrusion is disposed on the mattress body, and configured to be fastened to the back-section hole in the wheelchair back bottom. The fastener is disposed on the mattress body, and configured to be fastened to the wheelchair hip bottom. The second protrusion is disposed on the mattress body, and configured to be fastened to the foot-section hole in the wheelchair foot bottom.

A second mattress for integrated bed of the present invention is applicable to an integrated bed having a main bed unit that includes a bed back bottom provided with a back-section hole, a bed hip bottom, and a bed foot bottom provided with a foot-section hole, and a wheelchair unit separable from the main bed unit. This mattress for integrated bed has a mattress body, a first protrusion, a fastener, and a second protrusion. The first protrusion is disposed on the mattress body, and configured to be fastened to the back-section hole in the bed back bottom. The fastener is disposed on the mattress body, and configured to be fastened to the bed hip bottom. The second protrusion is disposed on the mattress body, and configured to be fastened to the foot-section hole in the bed foot bottom.

It is by virtue of the present invention to provide the mattresses that can be replaced easily when they are soiled.

DETAILED DESCRIPTION OF PREFERRED EMBODIMENTS

Figure 10:
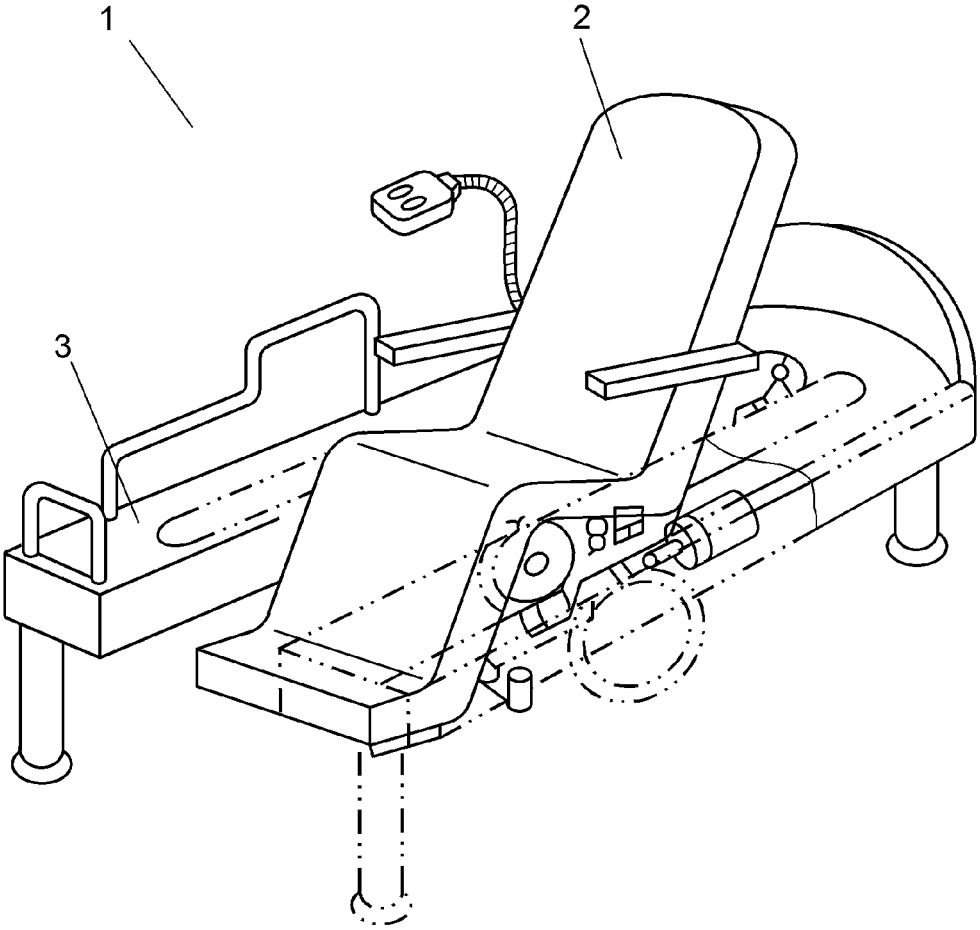
FIG. 10 PRIOR ART
FIG. 10 is a perspective view of a conventional integrated bed.

A drawback in conventional integrated bed 1 shown in FIG. 10 is that the mattress of wheelchair 2 is assumed not to be replaced. It is conceivable that the mattress gets soiled due to food spills and the like when being used as integrated bed 1 and wheelchair 2. There are thus concern that care workers need to bear a lot of trouble and energy to remove the soils, or spend complex time and effort to replace the mattress if it is not so constructed as to be easily replaceable when it becomes soiled.

Referring to the accompanying drawings, description is provided hereinafter of an exemplary embodiment of the present invention. Note that same reference marks are used to designate like structural components, and their descriptions may be omitted. In addition, the drawings indicate the components mainly and schematically to make them readily comprehensible.

Figure 1A:
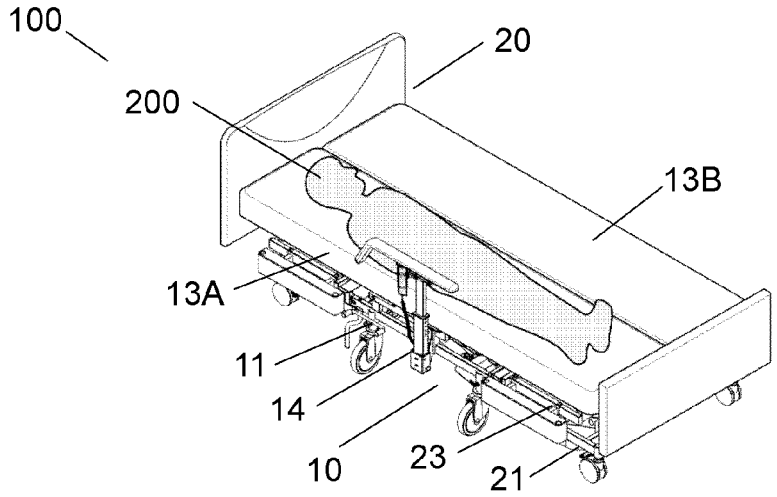
FIG. 1A is a perspective view of an integrated bed according to an exemplary embodiment of the present invention.
Figure 1B:
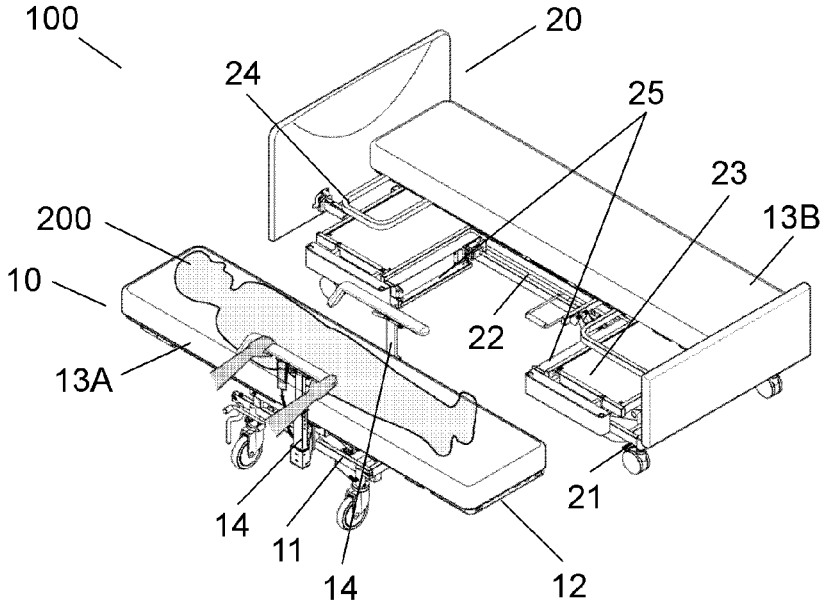
FIG. 1B is a perspective view of the integrated bed shown in FIG. 1A in a separated state.

FIG. 1A and FIG. 1B are drawings for use to describe integrated bed 100 according to this exemplary embodiment of the invention. FIG. 1A is a perspective view of integrated bed 100 in a combined state, and FIG. 1B is a perspective view of integrated bed 100 in a separated state, in which wheelchair unit 10 is separated. Integrated bed 100 includes main bed unit 20, and wheelchair unit 10 separable from main bed unit 20. Integrated bed 100 is capable of carrying care-receiver 200.

Wheelchair unit 10 includes main wheelchair section 11 that has casters, wheelchair bottom section 12 fixed to main wheelchair section 11 and has a seat surface and armrests 14 attached to main wheelchair section 11. A seating angle of the seat surface is changeable. Removable mattress 13A is fixed to wheelchair bottom section 12 with protrusions 132 to 134, which will be described later. Armrests 14 are configured to be slidable in multiple levels so that they can be pulled out vertically upward.

Main bed unit 20 includes bed base frame 21 that has casters, bed-lifting section 22, bed upper frame 23, bed bottom section 24, and bed wheelchair support 25. Bed-lifting section 22 is fixed to bed base frame 21, and includes a mechanism capable of changing a height of bed upper frame 23. Bed-lifting section 22 can thus change a height of the bed surface. Bed bottom section 24 is fixed to bed upper frame 23. Bed bottom section 24 includes a mechanism capable of changing a reclining posture of the seating surface. Bed wheelchair support 25 is fixed to bed upper frame 23, and is provided to secure wheelchair unit 10 to main bed unit 20. Removable mattress 13B is fixed to bed bottom section 24 with protrusions 132 to 134, as will be described later.

Figure 2A:
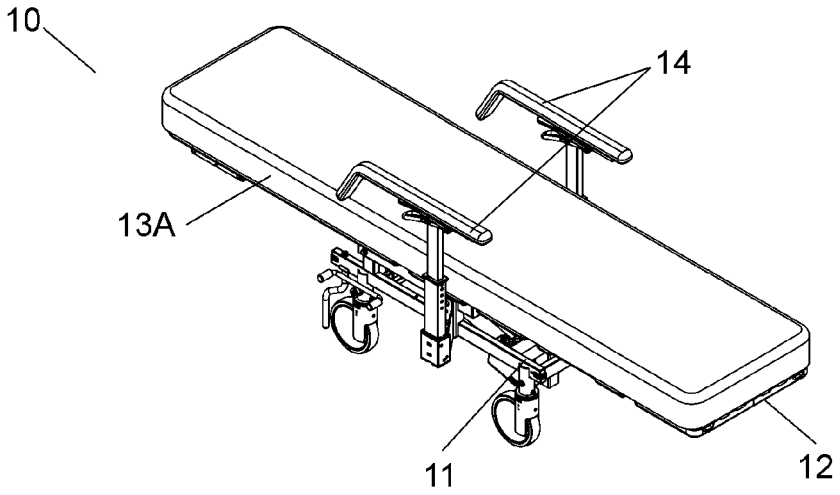
FIG. 2A is a perspective view of a wheelchair unit, which is in a flat posture, of the integrated bed shown in FIG. 1B.
Figure 2B:
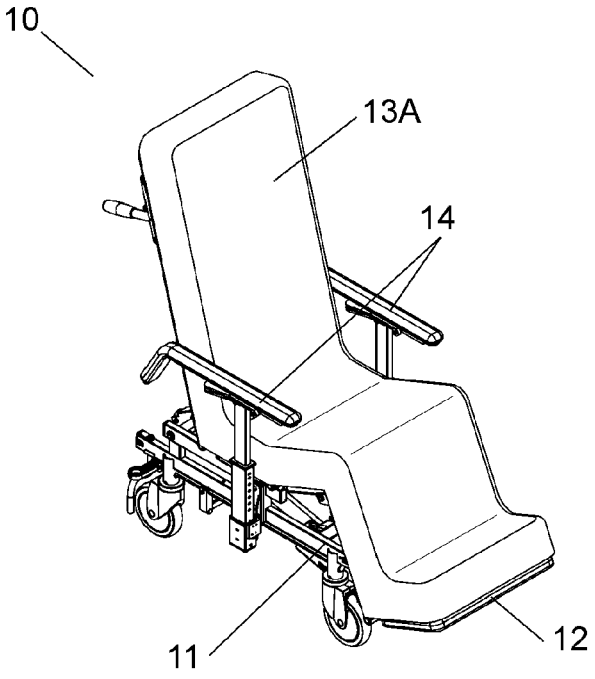
FIG. 2B is a perspective view of the wheelchair unit shown in FIG. 2A, in a chair posture.
Figure 3A:
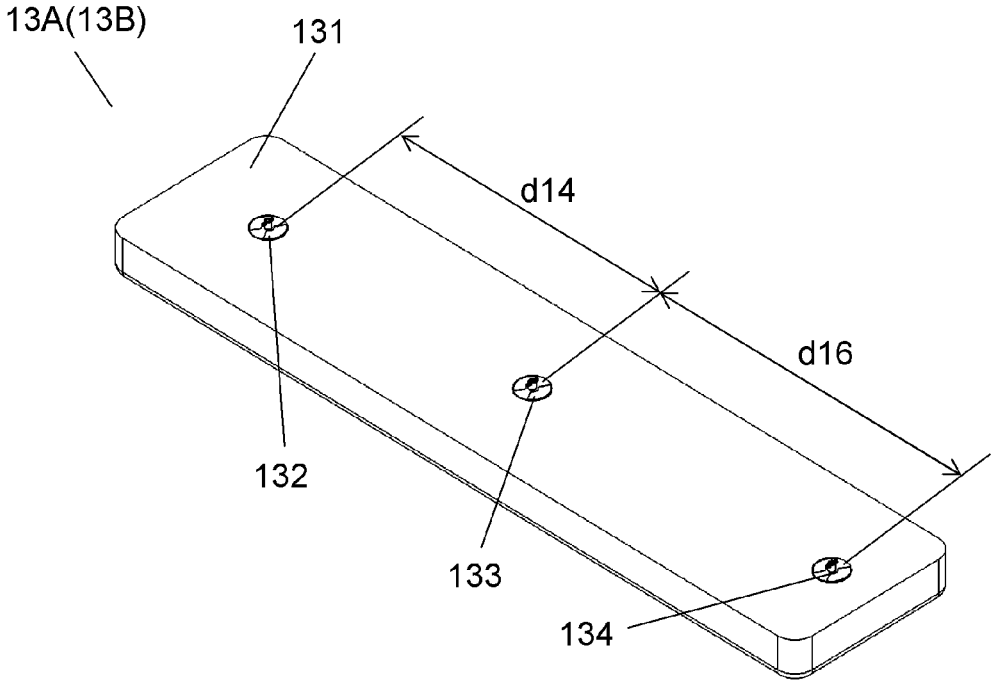
FIG. 3A is a perspective view of a mattress according to this exemplary embodiment of the present invention.
Figure 3B:
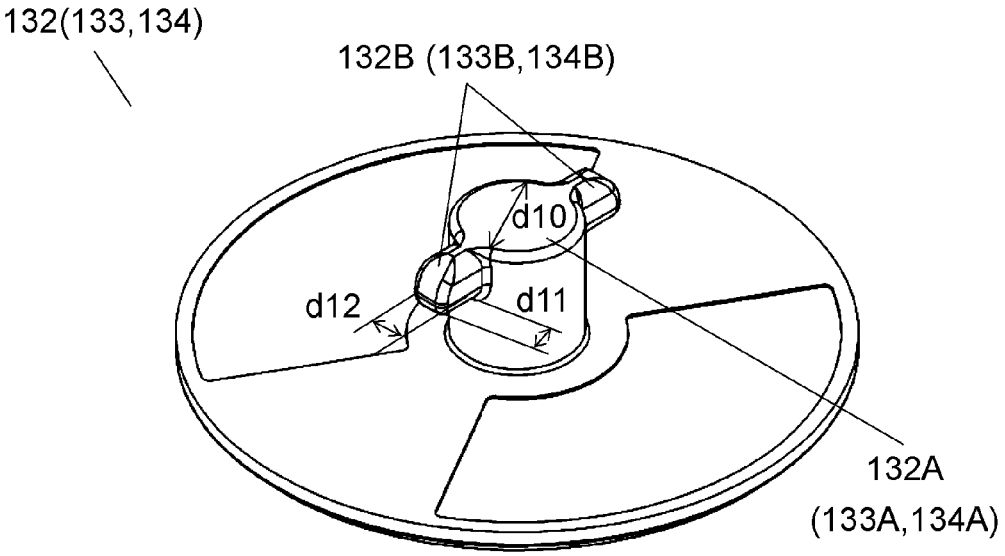
FIG. 3B is a perspective view of a protrusion of the mattress shown in FIG. 3A.

FIG. 2A and FIG. 2B are drawings for use to describe wheelchair unit 10. FIG. 2A is a perspective view of wheelchair unit 10 in a flat posture and FIG. 2B is a perspective view of wheelchair unit 10 in a chair posture. FIG. 3A and FIG. 3B are drawings for use to describe mattress 13A. FIG. 3A is a perspective view of mattress 13A, and FIG. 3B is a perspective view of first protrusion 132 bonded to mattress 13A.

After wheelchair unit 10 is separated from main bed unit 20, the reclining posture of wheelchair unit 10 can be changed by using wheelchair bottom section 12. That is, the posture can be changed from the flat posture in FIG. 2A to the chair posture in FIG. 2B. Wheelchair unit 10 in the chair posture shown in FIG. 2B can be used as a wheelchair. As described here, wheelchair unit 10 is convertible from the flat posture to the chair posture. In this case, mattress 13A is required to have a certain thickness, since pressure distribution capability is necessary for mattress 13A which is also used as a bed. If mattress 13A is thick, however, it may be difficult to bend when changing the shape of mattress 13A to convert into the chair posture or the like. In this situation, if mattress 13A is not fixed to wheelchair bottom section 12, there arises a possibility that mattress 13A does not bend along the shape of the chair and becomes loose when being converted into the chair posture. Mattress 13A is required to be deformed properly along the shape of the chair in order for the care-receiver to sit on. In other words, mattress 13A needs to be fixed securely to wheelchair bottom section 12.

For this reason, mattress 13A is provided with protrusions 132 to 134, as shown in FIG. 3A. Because mattress 13A is fixed to wheelchair bottom section 12 by using protrusions 132 to 134, it stays fixed securely even when the posture is changed. Note that mattress 13B shown in FIG. 1A and FIG. 1B also has a similar structure to mattress 13A, and can be fixed to bed bottom section 24. A method in which mattress 13A is fixed to wheelchair bottom section 12 is described hereinafter with reference to FIG. 3A and FIG. 3B.

As shown in FIG. 3A, mattress 13A includes mattress body 131, and protrusions 132 to 134 disposed on mattress body 131. Protrusion 132 designated as a first protrusion is disposed on a back section for care-receiver 200 (i.e., a position corresponding to wheelchair back bottom 121) when mattress body 131 is fixed to wheelchair bottom section 12. Protrusion 134 designated as a second protrusion is disposed on a foot-side section for care-receiver 200 (i.e., a position corresponding to wheelchair foot bottom 125). Protrusion 133 designated as a third protrusion is disposed on a hip section for care-receiver 200 (i.e., a position corresponding to wheelchair hip bottom 122). Protrusion 133 is a fastener configured to be fastened to wheelchair hip bottom 122. Protrusions 132 to 134 are secured to their respective positions on mattress body 131 by bonding, for instance.

As shown in FIG. 3B, protrusion 132 has circular column 132A, and two projections 132B that project rectilinearly in diametric directions of circular column 132A. Projections 132B are engaged in back-section hole 121A provided in wheelchair bottom section 12 so that mattress 13A is fixed securely to wheelchair bottom section 12, as details of which will be described later. Since each of protrusions 133 and 134 has a same structure as that of protrusion 132, details of circular column 133A and projections 133B of third protrusion 133, and circular column 134A and projections 134B of second protrusion 134 are skipped. Mattress 13A is fixed securely to wheelchair bottom section 12 by engagement of protrusions 133 and 134 in hip-section hole 122A and foot-section hole 125A, respectively.

Here, it is desirable that projections 132B are disposed in a direction parallel to the short side of mattress 13A (i.e., a breadth direction of the shoulders of care-receiver 200) in consideration of the method of fixing mattress 13A to wheelchair bottom section 12. This is because mattress 13A is slidable preferably in a direction parallel to the long side of mattress 13A (i.e., a direction of the body trunk of care-receiver 200), as will be described later.

In FIG. 3B, although two projections 132B are provided, there may be just one projection 132B if it can fix mattress 13A securely to wheelchair bottom section 12. It is also possible to provide two projections 132B arranged at an angle like a letter "V", three projections 132B arranged like a letter "T", or four projections 132B arranged like a letter "X".

Figure 4A:
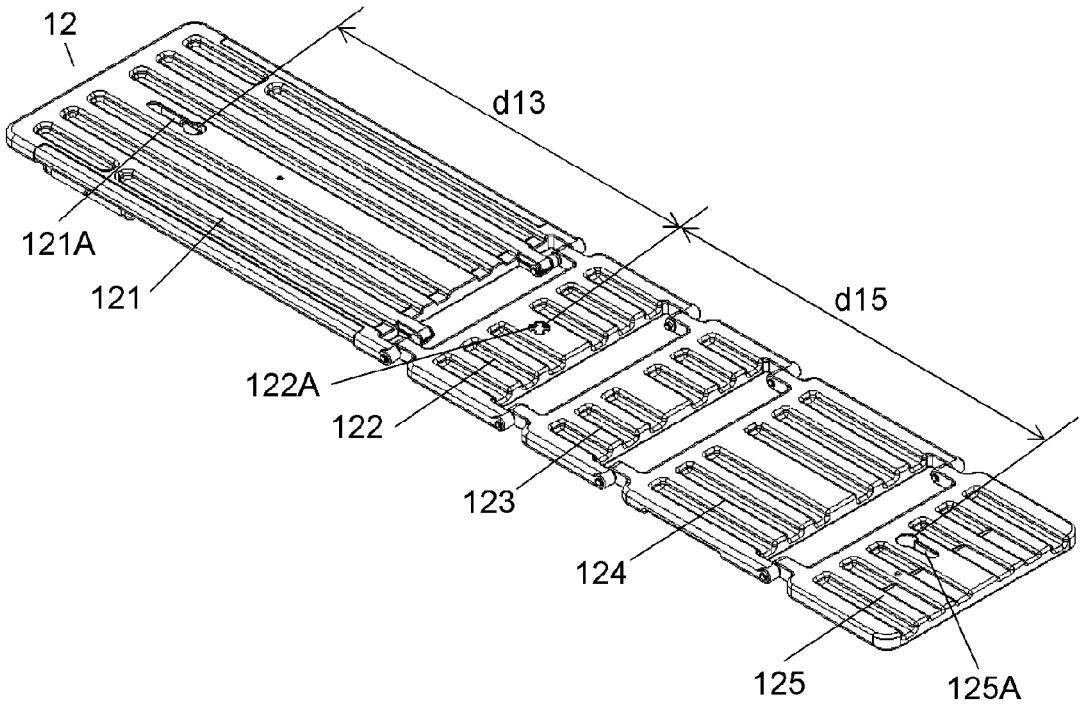
FIG. 4A is a perspective view of a wheelchair bottom section of the wheelchair unit shown in FIG. 2A.
Figure 4B:
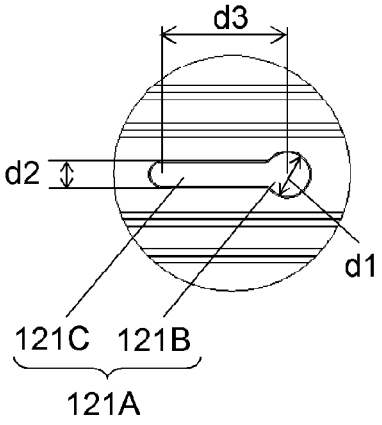
FIG. 4B is a partially enlarged view of a back-section hole in the wheelchair bottom section shown in FIG. 4A.
Figure 4C:
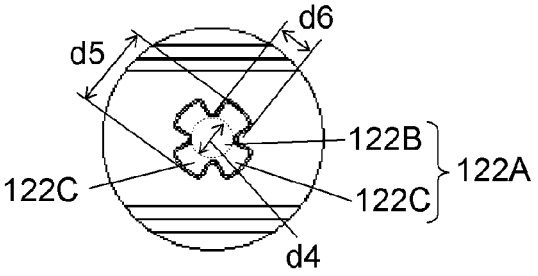
FIG. 4C is a partially enlarged view of a hip-section hole in the wheelchair bottom section shown in FIG. 4A.
Figure 4D:
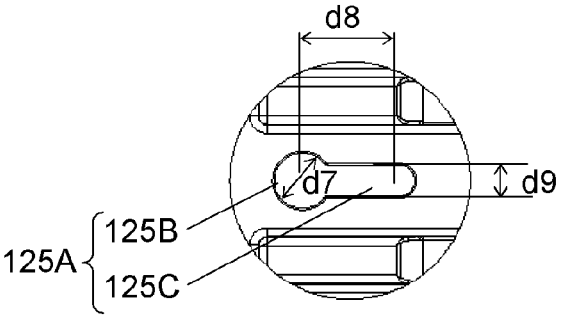
FIG. 4D is a partially enlarged view of a foot-section hole in the wheelchair bottom section shown in FIG. 4A.

FIG. 4A to FIG. 4D are drawings for use to describe holes provided in wheelchair bottom section 12 according to the exemplary embodiment. FIG. 4A is a perspective view of wheelchair bottom section 12, FIG. 4B is a partially enlarged view of back-section hole 121A, FIG. 4C is a partially enlarged view of hip-section hole 122A, and FIG. 4D is a partially enlarged view of foot-section hole 125A.

As shown in FIG. 4A, wheelchair bottom section 12 includes wheelchair back bottom 121, wheelchair hip bottom 122, wheelchair thigh bottom 123, wheelchair calf bottom 124, and wheelchair foot bottom 125. There are back-section hole 121A provided in wheelchair back bottom 121, hip-section hole 122A provided in wheelchair hip bottom 122, and foot-section hole 125A provided in wheelchair foot bottom 125, as the holes for respectively engaging protrusions 132, 133 and 134. In other words, protrusions 132, 133 and 134 are configured such that they are fastened respectively to back-section hole 121A, hip-section hole 122A and foot-section hole 125A.

As shown in FIG. 4B, back-section hole 121A has a keyhole shape formed of a combination of back-section round-hole portion 121B and back-section slot portion 121C. In order to fix mattress 13A securely to wheelchair bottom section 12, diameter d1 of back-section round-hole portion 121B is larger than a value given by addition of twice the length d11 of projection 132B to diameter d10 of circular column 132A of protrusion 132 shown in FIG. 3B. Furthermore, width d2 of back-section slot portion 121C is larger than diameter d10 of circular column 132A, but smaller than a value given by addition of length d11 of projection 132B to diameter d10 of circular column 132A. Meanwhile, back-section round-hole portion 121B can be of any shape other than a round shape as long as it has a size large enough to cause protrusion 132 to pass through. It is desirable that length d3 of back-section slot portion 121C is about 60 mm or larger so that mattress 13A is allowed to slide when wheelchair unit 10 is converted into the chair posture, though the details will be described later.

As shown in FIG. 4C, hip-section hole 122A has a shape of the letter "X" formed of a combination of hip-section round-hole portion 122B and four hip-section slot portions 122C. Alternatively, hip-section hole 122A may have a shape of the character "1" formed of a combination of hip-section round-hole portion 122B and two hip-section slot portions 122C. According to this exemplary embodiment, however, physical discomfort of care-receiver 200 can be relieved during the conversion from the flat posture to the chair posture because of the structure in which both the back section and the foot section of mattress 13A slide in their respective directions parallel to the long side of mattress 13A. It is therefore desirable that projection 133B corresponding to hip-section hole 122A is fastened so as not to shift at least in this direction. Diameter d4 of hip-section round-hole portion 122B is larger than diameter d10 of circular column 133A of protrusion 133, but smaller than a value given by addition of length d11 of projection 133B to diameter d10 of circular column 133A. In addition, length d5 of hip-section slot portion 122C is larger than a value given by addition of twice the length d11 of projection 133B to diameter d10 of circular column 133A of protrusion 133. Furthermore, width d6 of hip-section slot portion 122C is larger than width d12 of projection 133B.

Here, description is provided of a method for inserting protrusion 133 located in the hip section of mattress 13A (i.e., the protrusion in the center part of FIG. 3A) into hip-section hole 122A.

First, mattress 13A is turned to bring projections 133B to match with hip-section slot portions 122C, and protrusion 133 is inserted into hip-section hole 122A. After this, mattress 13A is turned so that mattress 13A and wheelchair bottom section 12 become parallel to each other. Protrusion 133 is thus caught in wheelchair hip bottom 122, so as not to come out. In addition, circular column 133A is held in contact with hip-section round-hole portion 122B, so that mattress 13A is fixed immovable in both the direction parallel to the long side and the direction parallel to the short side of mattress 13A.

Next, foot-section hole 125A is described. As shown in FIG. 4D, foot-section hole 125A has a keyhole shape formed of a combination of foot-section round-hole portion 125B and foot-section slot portion 125C. Diameter d7 of foot-section round-hole portion 125B is larger than a value given as the sum of twice the length d11 of projection 134B and diameter d10 of circular column 134A of second protrusion 134. Width d9 of foot-section slot portion 125C is larger than diameter d10 of circular column 134A, but smaller than a value given as the sum of length d11 of projection 134B and diameter d10 of circular column 134A. Meanwhile, foot-section round-hole portion 125B can be of any shape other than a round shape as long as it has a size large enough to cause second protrusion 134 to pass through.

Distance d13 between the center positions of back-section round-hole portion 121B and hip-section round-hole portion 122B is equal to distance d14 between the centers of circular column 132A of protrusion 132 and circular column 133A of protrusion 133. As described previously, protrusion 132 is the protrusion bonded to the back section of mattress 13A, and shown in the upper left part of FIG. 3A. Protrusion 133 is the protrusion bonded to the hip section of mattress 13A, and shown in the center part of FIG. 3A.

Furthermore, distance d16 between the centers of circular column 133A of protrusion 133 and circular column 134A of protrusion 134 is larger than distance d15 between the center positions of hip-section round-hole portion 122B and foot-section round-hole portion 125B. In addition, distance d16 is smaller than a value given as the sum of distance d15 between the center positions of hip-section round-hole portion 122B and foot-section round-hole portion 125B and length d8 of foot-section slot portion 125C. As previously described, protrusion 133 is bonded to the hip section of mattress 13A. Protrusion 134 is the protrusion bonded to the foot section of mattress 13A, and shown in the lower right part of FIG. 3A.

Figure 5A:
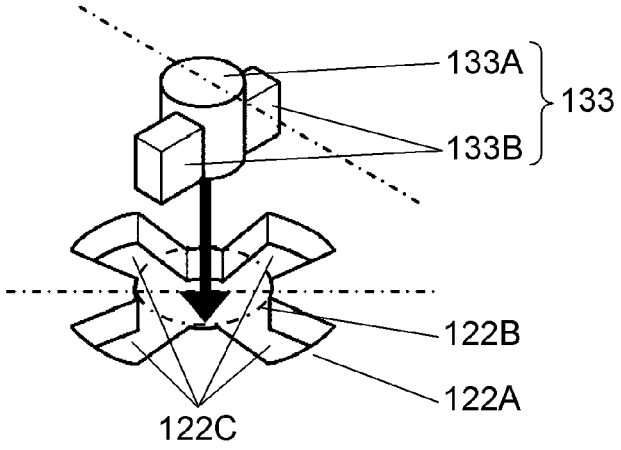
FIG. 5A is a partially enlarged view of the protrusion shown in FIG. 3A and the hip-section hole when a hip section of the mattress is being fastened.
Figure 5B:
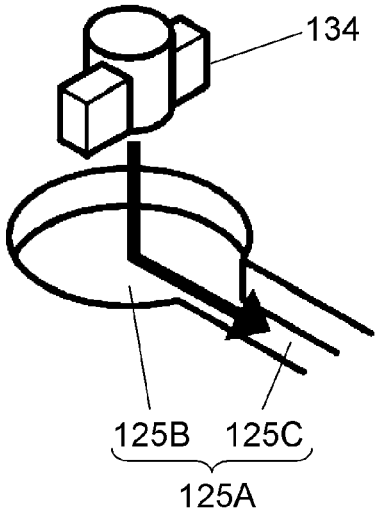
FIG. 5B is a partially enlarged view of the protrusion shown in FIG. 3A and the foot-section hole when a foot-side section of the mattress is being fastened.

FIG. 5A and FIG. 5B are drawings for use to describe in detail about a fixing method of mattress 13A, FIG. 5A is a perspective view when the hip section is being fastened, and FIG. 5B is a perspective view when the foot section is being fastened. FIG. 5A and FIG. 5B show only respective one of protrusions 133 and 134 individually.

When mattress 13A is fixed, the hip section is fastened first. For this purpose, hip-section hole 122A has a shape shown in FIG. 4C and FIG. 5A. First of all, mattress 13A is turned to bring projections 133B of protrusion 133 on the hip section of mattress 13A to match with hip-section slot portions 122C, and protrusion 133 is inserted into hip-section hole 122A. Mattress 13A is then turned about hip-section round-hole portion 122B so that mattress 13A becomes parallel to wheelchair bottom section 12. Since distance d13 and distance d14 are equal as previously noted, protrusion 133 bonded to the back section engages with back-section round-hole portion 121B when mattress 13A is brought in parallel with wheelchair bottom section 12. Then, as shown in FIG. 5B, protrusion 134 on the foot section of mattress 13A is inserted into foot-section round-hole portion 125B. For this operation, the care worker holds mattress 13A with his hands, and inserts protrusion 134 on the foot section of mattress 13A in foot-section round-hole portion 125B while slightly bending mattress 13A. Protrusion 134 shifts to a space inside foot-section slot portion 125C as soon as the care worker releases his hands from mattress 13A, and mattress 13A is then fixed to wheelchair bottom section 12.

Projections 133B of protrusion 133 are caught in wheelchair hip bottom 122 so as not to come out by virtue of this fixing method. In addition, circular column 133A is held in contact with hip-section round-hole portion 122B, so that mattress 13A is fixed immovable in both the direction parallel to the long side and the direction parallel to the short side of mattress 13A.

Moreover, projections 134B of protrusion 134 are also caught in wheelchair foot bottom 125 so as not to come out. In addition, circular column 134A is held in contact with foot-section slot portion 125C such that protrusion 134 is fastened in a slidable manner in a direction away from wheelchair hip bottom 122 along the direction parallel to the long side of mattress 13A while protrusion 134 is restrained in the direction parallel to the short side of mattress 13A.

In the process of converting wheelchair unit 10 into the chair posture, protrusion 132 slides to a head side of wheelchair back bottom 121, and mattress 13A also slides on wheelchair back bottom 121. When circular column 132A of protrusion 132 moves to a position inside back-section slot portion 121C, projections 132B are caught in wheelchair back bottom 121, and protrusion 132 becomes not to come out. In addition, as circular column 132A is held in contact with back-section slot portion 121C, protrusion 132 is fastened in a slidable manner in a direction away from wheelchair hip bottom 122 along the direction parallel to the long side of mattress 13A while protrusion 132 is restrained in the direction parallel to the short side of mattress 13A.

Third protrusion 133 on the hip section of mattress 13A remains immovable since it is fixed by hip-section hole 122A when wheelchair unit 10 is converted from the flat posture into the chair posture shown in FIG. 2B.

A part that supports the back of care-receiver 200, that is, the back section of mattress 13A is fixed to wheelchair bottom section 12. Wheelchair bottom section 12 has a center of rotation, and this center of rotation of wheelchair bottom section 12 is different from that of mattress 13A. There is thus a force exerted upon mattress 13A to shift on wheelchair back bottom 121 toward the head side of care-receiver 200, and, because of this force, protrusion 132 on the back section of mattress 13A slides along back-section slot portion 121C. According to this exemplary embodiment, the feeling of discomfort suffered by care-receiver 200 during conversion of wheelchair unit 10 into the chair posture can be alleviated by virtue of the above structure.

In regard to the foot section, projections 134B of protrusion 134 stay in contact with wheelchair foot bottom 125, since distance d16 is larger than distance d15, and protrusion 134 is located in foot-section slot portion 125C. This structure prevents mattress 13A from becoming lifted above wheelchair foot bottom 125. When wheelchair unit 10 is converted into the chair posture under this condition, it is not easy to bend mattress 13A. Protrusion 134 is therefore configured to slide to the foot side of care-receiver 200 (i.e., the opposite to wheelchair hip bottom 122) with regard to wheelchair foot bottom 125, and protrusion 134 moves to the end of foot-section slot portion 125C. Because of this movement of protrusion 134, mattress 13A can follow the change in shape of wheelchair foot bottom 125 while being fixed to wheelchair foot bottom 125, so that wheelchair unit 10 can be converted into the chair posture.

Note that bed bottom section 24 shown in FIG. 1B is provided with holes similar to those provided in wheelchair bottom section 12. Since locations and structures of the holes and their fixing methods are similar to each other between wheelchair bottom section 12 and bed bottom section 24, the details are omitted. To be specific, a bed back bottom corresponds to wheelchair back bottom 121, a bed hip bottom corresponds to wheelchair hip bottom 122, and a bed foot bottom corresponds to wheelchair foot bottom 125. Like mattress 13A, mattress 13B also has protrusions 132 to 134, as shown in FIG. 3A. Protrusions 132 to 134 are disposed respectively at a position corresponding to the back-section hole in the bed back bottom, at a position corresponding to the hip-section hole in the bed hip bottom, and at a position corresponding to the foot-section hole in the bed foot bottom.

With the structure described above, mattress 13A of integrated bed 100 in this exemplary embodiment is capable of following the chair posture of wheelchair unit 10 which is separable for use as a wheelchair. Furthermore, mattresses 13A and 13B do not inflict the feeling of discomfort on care-receiver 200 who lies on integrated bed 100. As described, mattresses 13A and 13B can provide comfortable integrated bed 100.

In the above exemplary embodiment, description has been provided of mattress 13A having protrusion 133 (referred to FIG. 3A) fastened to hip-section hole 122A of wheelchair hip bottom 122 shown in FIG. 4A. This structure can positively fix mattress 13A to wheelchair hip bottom 122. That is, it can prevent mattress 13A from being lifted from wheelchair hip bottom 122 in the process of converting wheelchair unit 10 into the chair posture.

Alternatively, it is possible to use other fastening members such as a hook-and-loop fastener or a hook, instead of the structure of fastening protrusion 133 into hip-section hole 122A. In other words, mattress 13A only needs to have a fastening member (fastener) configured to be fastened to wheelchair hip bottom 122.

Figure 6:
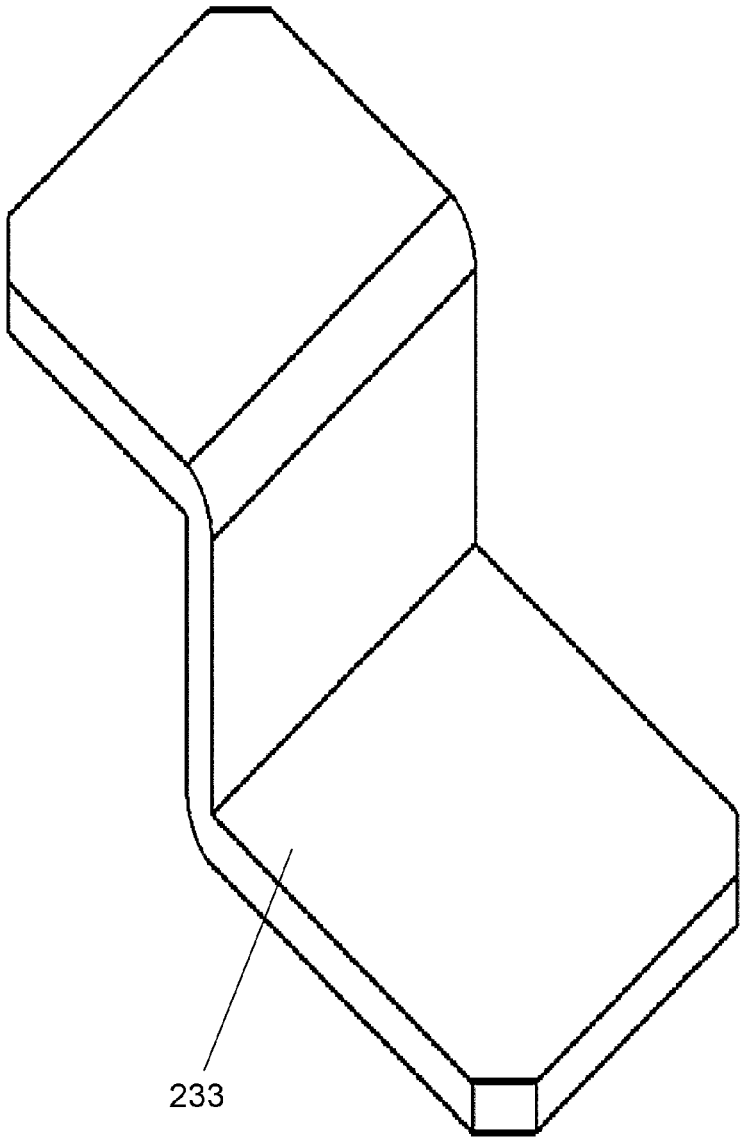
FIG. 6 is a schematic illustration showing a hook that functions as a fastener of an alternative example according to the exemplary embodiment of the invention.
Figure 7:
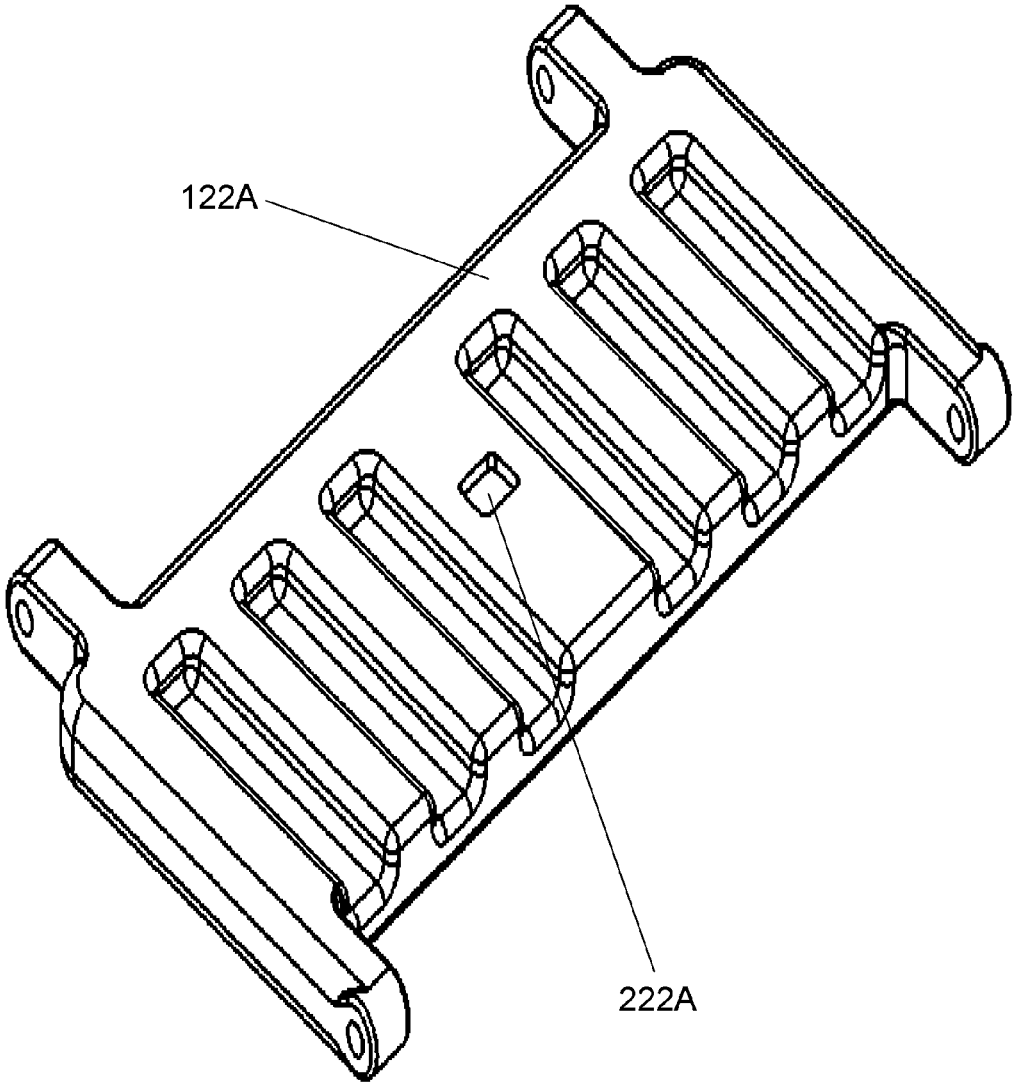
FIG. 7 is a schematic illustration showing a hip-section hole for fastening the hook shown in FIG. 6.

As one example of such other alternatives, hook 233 shown in FIG. 6 may be attached to mattress 13A in place of protrusion 133. In this case, hip-section square hole 222A is provided in wheelchair hip bottom 122, as shown in FIG. 7. Hook 233 can be fastened (engaged) to wheelchair hip bottom 122 by inserting it into hip-section square hole 222A.

Figure 8:
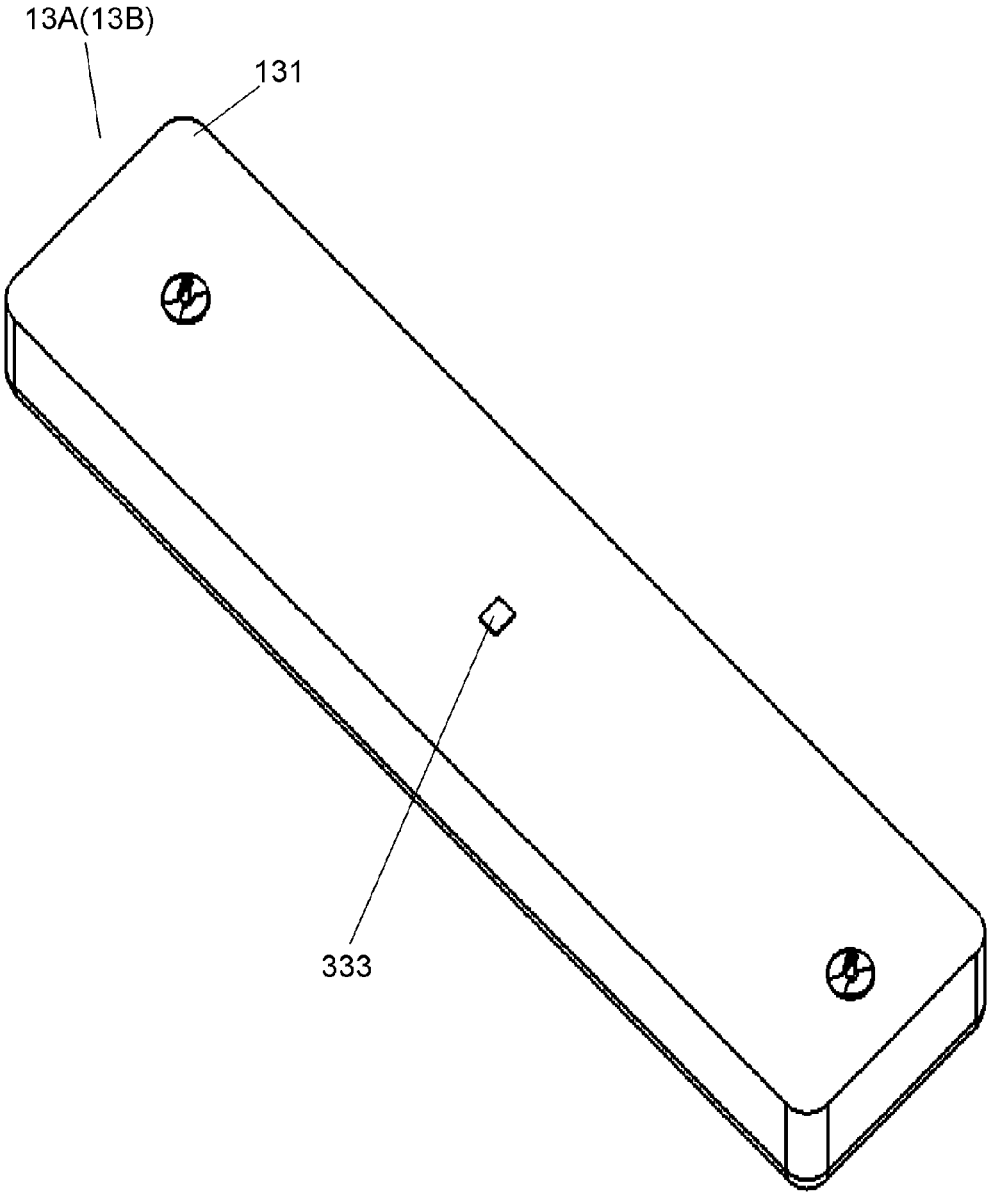
FIG. 8 is a schematic illustration showing one of a pair of hook-and-loop fasteners that functions as a fastener of another alternative example according to the exemplary embodiment of the invention.
Figure 9:
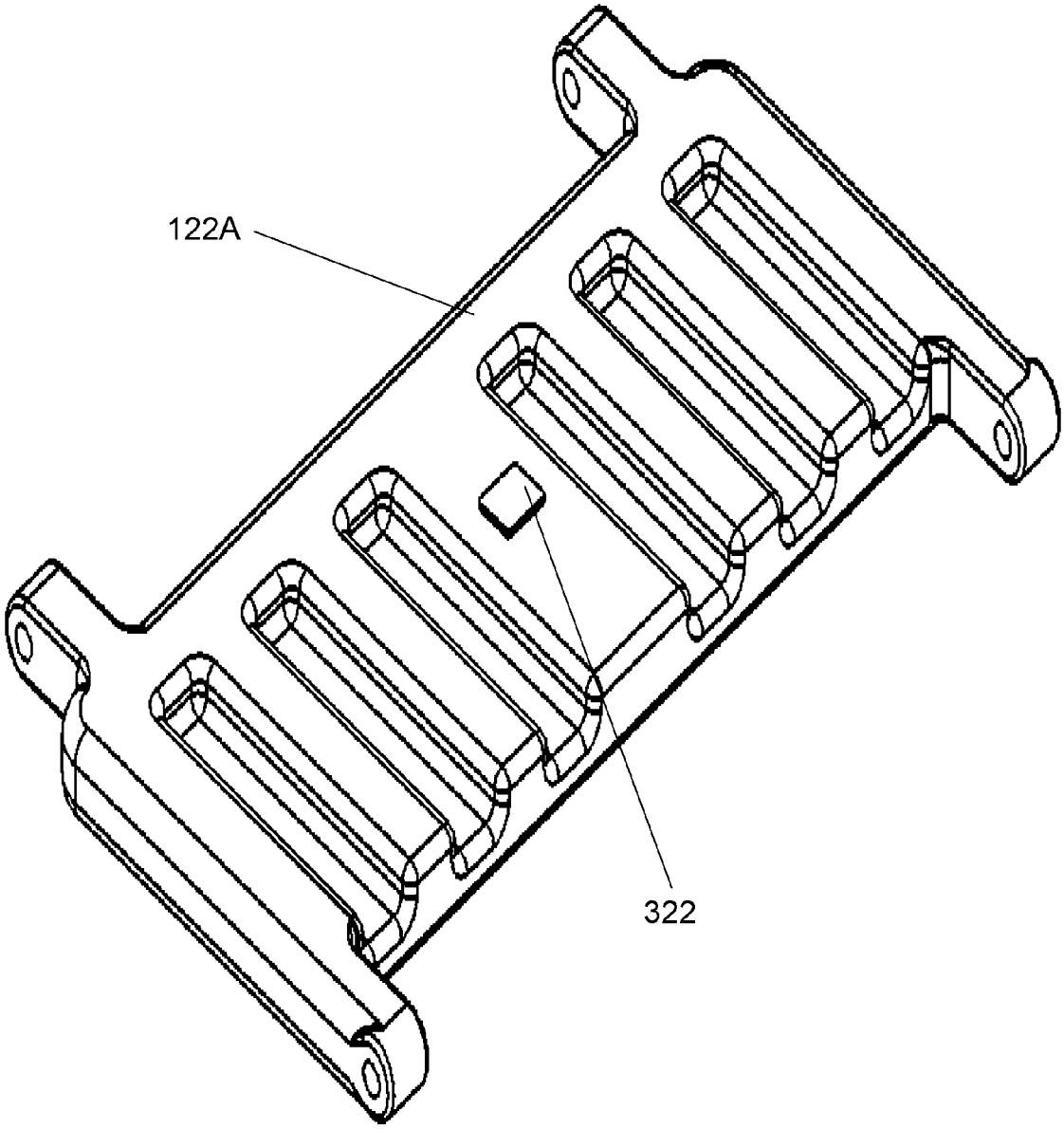
FIG. 9 is a schematic illustration showing another of the pair of hook-and-loop fasteners disposed on the wheelchair hip-bottom side for fastening the one of the pair of hook-and-loop fasteners shown in FIG. 8.

As another alternative example, hook-and-loop fastener 333 shown in FIG. 8 may be placed in the center of mattress body 131 instead of protrusion 133. In this instance, hook-and-loop fastener 322 is attached to the center of wheelchair hip bottom 122 as shown in FIG. 9. Hook-and-loop fastener 333 can be fastened to wheelchair hip bottom 122 by joining it to hook-and-loop fastener 322.

It is most preferable to adopt protrusion 133 shown in FIG. 3A for the fastener in the light of avoiding the mattress from being lifted due to forces imposed in a plurality of directions. In particular, it is preferable to provide protrusion 133 with at least two projections 133B projecting from the side face of circular column 133A that constitutes protrusion 133, in consideration of making them counteract the forces imposed in the plurality of directions. Likewise, it is also desirable to provide protrusions 132 and 134 with at least two projections 132B and 134B projecting from the corresponding side faces of circular columns 132A and 134A, respectively, from the viewpoint of achieving more positive fixation.

Mattress body 131 is preferably formed to be a single-piece unit rather than separated into individual pieces that correspond respectively to the individual bottom portions such as wheelchair back bottom 121 and wheelchair hip bottom 122 shown in FIG. 4A. Such a structure eliminates difference in level in mattress 13A when placed flat, and it can hence avoid care-receiver 200 from feeling discomfort when used as a bed.

Meanwhile, wheelchair back bottom 121 has the function of supporting weight of a back section of care-receiver 200. Wheelchair hip bottom 122 has the function of supporting weight of a hip section of care-receiver 200. Wheelchair thigh bottom 123 has the function of supporting weight of a thigh section of care-receiver 200. Wheelchair calf bottom 124 has the function of supporting weight of a calf section of care-receiver 200. Wheelchair foot bottom 125 has the function of supporting weight of a foot section of care-receiver 200. Wheelchair back bottom 121, wheelchair hip bottom 122, wheelchair thigh bottom 123, wheelchair calf bottom 124 and wheelchair foot bottom 125 are arranged contiguously in this order and pivotally coupled with each other to form wheelchair bottom section 12.

Mattress 13B may be provided with a fastening member such as a hook-and-loop fastener or a hook in order to fasten it to bed bottom section 24 shown in FIG. 1B. That is, the fastening member such as a hook-and-loop fastener and a hook configured to be fastened to the position corresponding to the bed hip bottom may be disposed on mattress 13B. In this case, a structure like hip-section square hole 222A shown in FIG. 7 or hook-and-loop fastener 322 shown in FIG. 9 is disposed at a position in bed bottom section 24 corresponding to the fastener on mattress 13B. As the fastening member, it is most preferable to dispose protrusion 133 shown in FIG. 3B at the position corresponding to the back-section hole in the bed back bottom in the viewpoint of avoiding mattress 13B from being lifted.

Here, information is supplementary added about the bed back bottom, the bed hip bottom and the bed foot bottom included in main bed unit 20, and the holes disposed therein. Their shapes and configurations are same as those of wheelchair bottom section 12 shown in FIG. 4A. In other words, the bed back bottom, the bed hip bottom and the bed foot bottom have the same shapes and configurations as wheelchair back bottom 121, wheelchair hip bottom 122 and wheelchair foot bottom 125, respectively. In addition, a back-section hole in the bed back bottom, a hip-section hole in the bed hip bottom and a foot-section hole in the bed foot bottom have the same shapes and configurations as back-section hole 121A, hip-section hole 122A and foot-section hole 125A, respectively.

A bed that uses the mattress for integrated bed according to the present invention includes a part that is separable as a wheelchair, and it is therefore useful as both the wheelchair and the bed for caring for a bedridden elderly or a patient.

What is claimed is:

1. A mattress comprising:

a mattress body;

a first protrusion on the mattress body, the first protrusion being configured to be fastened to a back-section hole in a wheelchair back bottom of an integrated bed;

a fastener on the mattress body, the fastener being configured to be fastened to a wheelchair hip bottom of the integrated bed; and a second protrusion on the mattress body, the second protrusion being configured to be fastened to a foot-section hole in a wheelchair foot bottom of the integrated bed, wherein each of the first protrusion and the second protrusion includes a circular column and at least two projections projecting from a side face of the circular column, and wherein each of the at least two projections extends in a direction parallel to a shorter side of the mattress.

2. The mattress according to claim 1, wherein:

the wheelchair hip bottom includes a hip-section hole, and the fastener includes a third protrusion configured to be fastened to the hip-section hole.

3. The mattress according to claim 2, wherein:

the third protrusion includes a circular column and at least two projections projecting from a side face of the circular column, and each of the at least two projections of the third protrusion extends in a direction parallel to one of a shorter side of the mattress and a longer side of the mattress.

4. The mattress according to claim 3, wherein the mattress body is a single-piece unit.

5. The mattress according to claim 2, wherein the mattress body is a single-piece unit.

6. An integrated bed comprising:

a mattress;

a main bed unit; and a wheelchair unit that is separable from the main bed unit and has a wheelchair back bottom, a wheelchair hip bottom and a wheelchair foot bottom, wherein the mattress comprises:

a mattress body;

a first protrusion on the mattress body, the first protrusion being configured to be fastened to a back-section hole in the wheelchair back bottom;

a second protrusion on the mattress body, the second protrusion being configured to be fastened to a foot-section hole in the wheelchair foot bottom; and a third protrusion on the mattress body, the third protrusion being configured to be fastened to the wheelchair hip bottom;

wherein each of the first protrusion and the second protrusion includes a circular column and at least two projections projecting from a side face of the circular column, and wherein each of the at least two projections extends in a direction parallel to a shorter side of the mattress.

7. The integrated bed according to claim 6, wherein the third protrusion is configured to be fastened to a hip-section hole in the wheelchair hip bottom, the hip-section hole has a shape of a letter X.

8. The integrated bed according to claim 7, wherein each of the back-section hole and the foot-section hole has a keyhole shape defined by a round-hole portion and a slot portion.

9. The integrated bed according to claim 8, wherein a distance between a center position of the round-hole portion of the back-section hole and a center position of the hip-section hole is equal to a distance between a center of the first protrusion and a center of the third protrusion.

10. The integrated bed according to claim 9, wherein a length of the slot portion of the foot-section hole is defined as d8, a distance between a center position of a round-hole portion of the hip-section hole and the round-hole portion of the foot-section hole is defined as d15, a distance between a center of the second protrusion and the center of the third protrusion is defined as d16, and an expression $d15<d16<(d15+d8)$ is satisfied.

11. The integrated bed according to claim 8, wherein a length of the slot portion of the foot-section hole is defined as d8, a distance between a center position of a round-hole portion of the hip-section hole and the round-hole portion of the foot-section hole is defined as d15, a distance between a center of the second protrusion and a center of the third protrusion is defined as d16, and an expression $d15<d16<(d15+d8)$ is satisfied.

12. The integrated bed according to claim 6, wherein each of the back-section hole and the foot-section hole has a keyhole shape defined by a round-hole portion and a slot portion.

13. The integrated bed according to claim 12, wherein the third protrusion is configured to be fastened to a hip-section hole in the wheelchair hip bottom, and a distance between a center position of the round-hole portion of the back-section hole and a center position of the hip-section hole is equal to a distance between a center of the first protrusion and a center of the third protrusion.

14. The integrated bed according to claim 13, wherein a length of the slot portion of the foot-section hole is defined as d8, a distance between a center position of a round-hole portion of the hip-section hole and the round-hole portion of the foot-section hole is defined as d15, a distance between a center of the second protrusion and the center of the third protrusion is defined as d16, and an expression $d15<d16<(d15+d8)$ is satisfied.

15. The integrated bed according to claim 12, wherein the third protrusion is configured to be fastened to a hip-section hole in the wheelchair hip bottom, and a length of the slot portion of the foot-section hole is defined as d8, a distance between a center position of a round-hole portion of the hip-section hole and the round-hole portion of the foot-section hole is defined as d15, a distance between a center of the second protrusion and a center of the third protrusion is defined as d16, and an expression d15<d16<(d15+d8) is satisfied.

16. An integrated bed comprising:

a mattress;

a main bed unit; and a wheelchair unit that is separable from the main bed unit and has a wheelchair back bottom, a wheelchair hip bottom and a wheelchair foot bottom, wherein the mattress comprises:

a mattress body;

a first protrusion on the mattress body, the first protrusion being configured to be fastened to a back-section hole in the wheelchair back bottom;

a second protrusion on the mattress body, the second protrusion being configured to be fastened to a foot-section hole in the wheelchair foot bottom; and a third protrusion on the mattress body, the third protrusion being configured to be fastened to a hip-section hole in the wheelchair hip bottom;

wherein each of the first protrusion and the second protrusion includes a circular column and at least two projections projecting from a side face of the circular column, wherein each of the at least two projections extends in a direction parallel to a shorter side of the mattress, wherein each of the back-section hole and the foot-section hole has a keyhole shape defined by a round-hole portion and a slot portion, wherein the hip-section hole has a round-hole portion, wherein a length of the slot portion of the foot-section hole is defined as d8, a distance between a center position of the round-hole portion of the hip-section hole and the round-hole portion of the foot-section hole is defined as d15, a distance between a center of the second protrusion and a center of the third protrusion is defined as d16, and an expression d15<d16<(d15+d8) is satisfied.

17. A mattress comprising:

a mattress body;

a first protrusion on the mattress body, the first protrusion being configured to be fastened to a back-section hole in a wheelchair back bottom of an integrated bed;

a second protrusion on the mattress body, the second protrusion being configured to be fastened to a foot-section hole in a wheelchair foot bottom of the integrated bed; and a third protrusion on the mattress body, the third protrusion being configured to be fastened to a hip-section hole in a wheelchair hip bottom of the integrated bed;

wherein each of the first protrusion and the second protrusion includes a circular column and at least two projections projecting from a side face of the circular column, wherein each of the at least two projections extends in a direction parallel to a shorter side of the mattress, wherein each of the back-section hole and the foot-section hole has a keyhole shape defined by a round-hole portion and a slot portion, wherein the hip-section hole has a round-hole portion, wherein a length of the slot portion of the foot-section hole is defined as d8, a distance between a center position of the round-hole portion of the hip-section hole and the round-hole portion of the foot-section hole is defined as d15, a distance between a center of the second protrusion and a center of the third protrusion is defined as d16, and an expression d15<d16<(d15+d8) is satisfied.

* * * * *